United States Patent [19]

Lichtenwalter et al.

[11] 4,342,348

[45] Aug. 3, 1982

[54] VENEER LATHE CHUCK ASSEMBLY

[75] Inventors: Robert H. Lichtenwalter, Tacoma; Darrell E. Pierson, Federal Way, both of Wash.

[73] Assignee: Weyerhaeuser Company, Tacoma, Wash.

[21] Appl. No.: 165,918

[22] Filed: Jul. 3, 1980

[51] Int. Cl.[3] ..... B27C 7/04; B27L 5/00

[52] U.S. Cl. ..... 144/209 R; 82/40 R; 142/53

[58] Field of Search ..... 82/40; 142/53, 55, 57; 144/209 R; 279/1 R

[56] References Cited

U.S. PATENT DOCUMENTS

| | | | |
|---|---|---|---|
| 2,333,055 | 10/1943 | Terrell | 142/53 |
| 2,879,816 | 3/1959 | Cook et al. | 144/209 R |
| 3,044,511 | 7/1962 | Wieckman et al. | 144/209 R |
| 3,110,330 | 11/1963 | Heth et al. | 144/209 R |
| 3,323,566 | 6/1967 | Hitt | 142/53 |
| 3,513,891 | 5/1970 | Heth | 144/209 R |
| 4,141,397 | 2/1979 | Schmidt | 144/209 R |
| 4,271,881 | 6/1981 | Hitt | 144/209 R |

*Primary Examiner*—W. D. Bray

[57] ABSTRACT

An improved chuck assembly for use in a veneer peeling lathe has retractable chuck pairs comprised of inner and outer rotatable chucks. At least one of the smaller inner chucks has a plurality of relatively chisel-like teeth extending outwardly from the base in a star pattern. At least one of the larger outer chucks has a plurality of thin chisel-like teeth extending outwardly from the circumferential edge of a body member. An improved means for removably attaching the large chuck to its spindle is provided.

7 Claims, 7 Drawing Figures

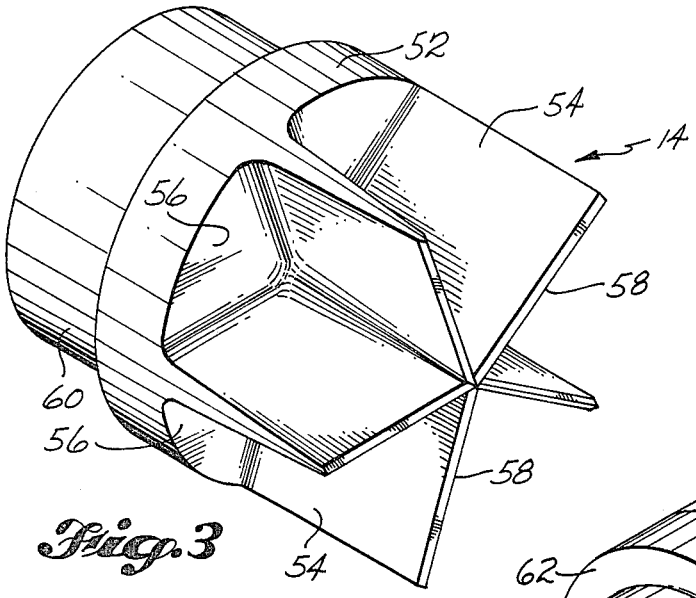
Fig. 3
Fig. 4
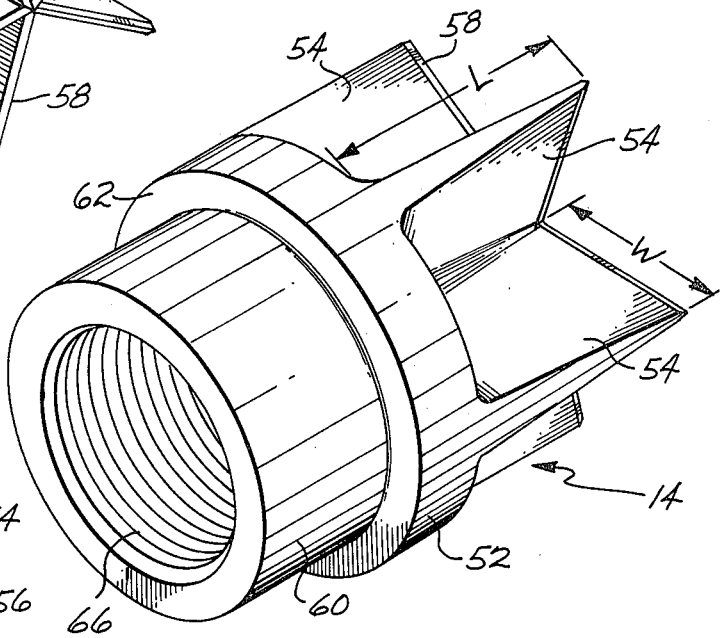
Fig. 5
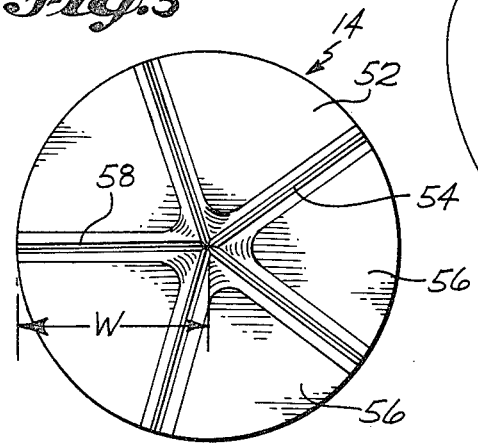
Fig. 6
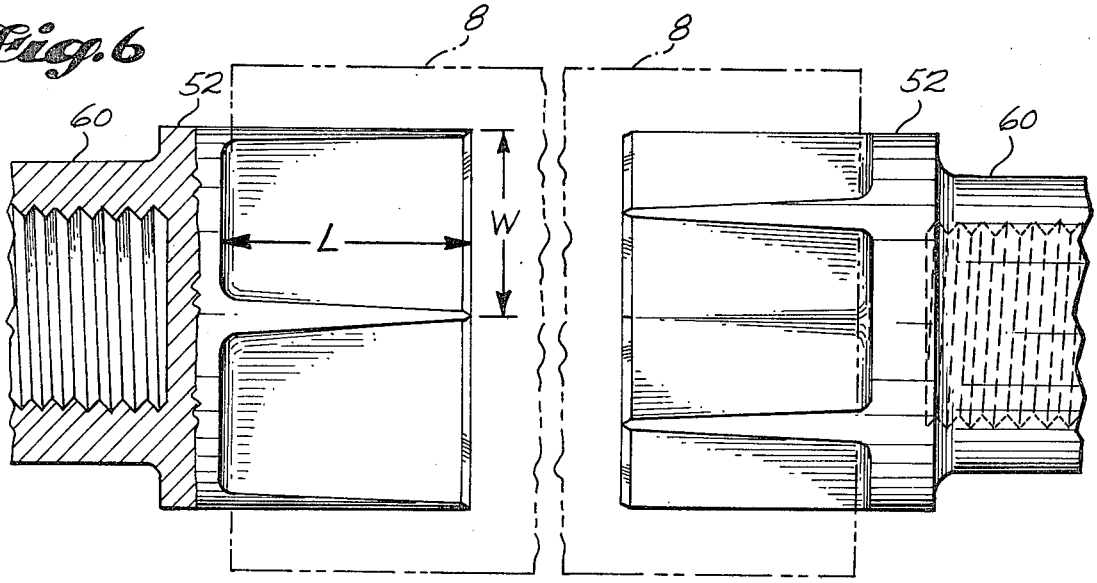

VENEER LATHE CHUCK ASSEMBLY

BACKGROUND OF THE INVENTION

This invention relates generally to a chuck assembly for use in a veneer lathe system. More particularly, it relates to a chuck assembly having retractable inner and outer chucks for allowing the peeling process to peel large plyblocks down to a minimum core diameter.

One step in the manufacture of plywood is the production of the thin veneer sheets. Traditionally in the manufacture of commodity type plywood, usually from typical softwood species such as Douglas fir and the Southern pines, a rotary type veneer lathe is used. Briefly, a plyblock (usually an 8'6" long, fairly large log segment) is charged into the veneer lathe and chucked for spinning and peeling. The chucks support the plyblock and apply torque to turn it as it is peeled down by the knife moving inwardly toward the turning axis.

Over the years, the average block diameter being charged into the veneer lathe has descreased as the supply of large logs has decreased. Consequently, in today's veneer manufacturing facilities, the lathes must be capable of accommodating smaller plyblocks while maintaining an economic rate of production. As the cost of the incoming raw material (the plyblock) continues to escalate, it also becomes imperative to generate the maximum amount of veneer out of any particular plyblock that is charged into the lathe. In the past, for example, when large plyblocks were consistently available at a reasonable cost, there was not a great incentive to reduce the core diameter to lower levels. As previously pointed out, however, with the increasing cost in raw material, there is now an incentive to peel a plyblock down to the smallest feasible diameter.

Of course, as it will be recognized by those skilled in the art, one problem in peeling small logs or in peeling large logs down to a smaller core diameter, is that any chuck assembly within a veneer lathe must be able to function properly and not interfere with the action of the knife. It is known in the industry to utilize inner and outer chucks mounted on laterally movable spindles so as to be retractable, thereby accommodating the larger incoming logs while allowing the lathe and knife to peel the block down to a relatively small core diameter by having the large outer chucks retract, leaving the smaller inner chucks to continue turning the block. The inner and outer chucks will normally have a plurality of chisel-like teeth mounted on their outer faces for gripping and turning purposes.

During the typical plyblock charging step, an individual block will be appropriately positioned within the lathe between the chuck pairs which are then substantially simultaneously moved toward the log and grip it. The spindles are then caused to rotate in a controlled manner, thereby spinning the block. As the knife moves radially inwardly and begins generating a ribbon of veneer, both chucks will be driving the block. As the knife begins to approach the outer periphery of the large chucks, suitable sensing means will detect the presence of the large chucks and generate a signal to cause the large chucks to retract. The small chucks will continue turning the block and as the knife approaches the periphery of the small chucks, a signal will be generated to cause the knife to return and the small chucks to retract, thereby dropping the resulting core.

It is very advantageous to peel a plyblock down to a core diameter on the order of 3". Typically, the best available chucking systems for veneer lathes will result in a core diameter which is approximately 4" in diameter, thereby leaving a considerable amount of what could otherwise be converted to veneer on the core. It does present a problem when peeling plyblocks down to such a small diameter in that oftentimes the chucks will split the ends of the block and in some instances "spin-out" will occur, which is a situation where the chucks have so much torque applied to them they spin within the block as the knife exerts its cutting force. Neither of these conditions is desirable and both result in a loss in usable veneer from the plyblock. Thus, in designing a chucking system for small logs and for peeling down to small core diameters, any resulting chuck structure should reduce the occurrence of both core spinouts and split ends.

In addition, any chucking system must be designed with ease of maintenance in mind, particularly when a dual chucking system is utilized where the small chuck slides within a bore of a large chuck. Oftentimes, teeth are broken and either the small chuck or the large chuck must be removed from the overall chucking system for maintenance or replacement. It thus becomes necessary to design the chucking assembly for quick removal and replacement.

Thus, from the foregoing, one object of the present invention is to allow the production of usable veneer from plyblocks down to a core diameter on the order of 3" or less.

Yet a further object of this invention is to provide a small log chucking system that has reduced spinouts and core splitting at the ends.

Yet a further object of this invention is to provide ease of maintenance when either the small or large chuck must be repaired or replaced.

These and many other objects of the present invention will be better understood and fully appreciated when reading the specification to follow in conjunction with the attached drawings.

SUMMARY OF THE INVENTION

Briefly stated, the present invention is practiced in one form in a veneer lathe having a dual chucking system where at least one of the chuck pairs has a small chuck slidable within a large chuck and with the small chuck having a plurality of at least three chisel-like thin teeth mounted on a base and extending outwardly therefrom and joined at the center line of the chuck. The small chuck is a single member and is affixed to its movable spindle through a quick release mounting means. The large chuck is comprised of a plurality of chisel-like teeth spaced circumferentially about the face of a cylindrical annulus within which the small chuck slides. The large chuck is mounted on its spindle for ease of removal and is attached thereto through a split ring and spacer collar arrangement.

BRIEF DESCRIPTION OF THE DRAWINGS

FIGS. 3 and 4 are isometric views of the single piece small chuck.

FIG. 5 is an end view of the small chuck showing the teeth.

FIG. 6 is a side view partially broken away showing a pair of small chucks as they are imbedded in the ends of a plyblock.

DETAILED DESCRIPTION OF THE PREFERRED EMBODIMENT

Figure 1:
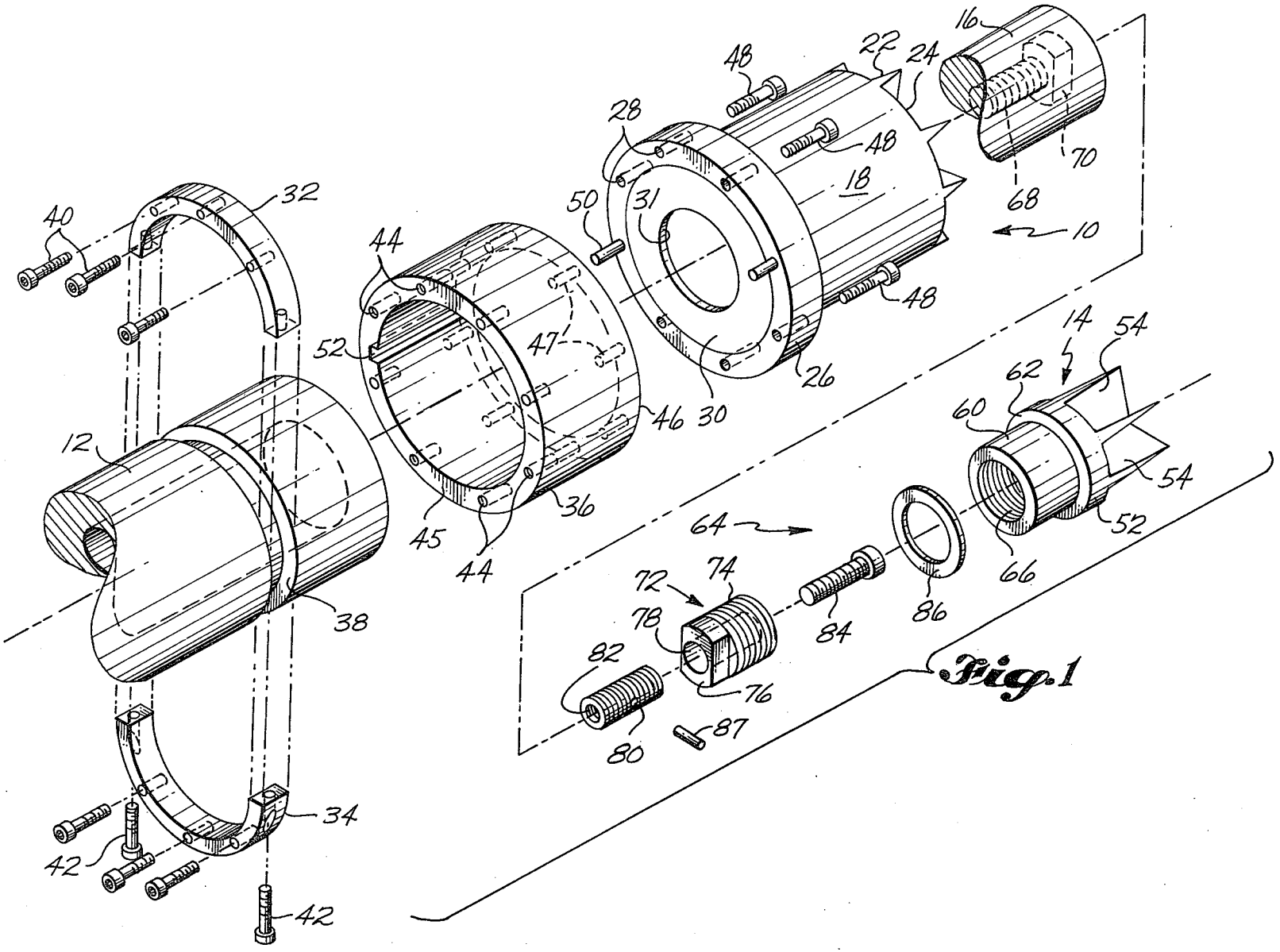
FIG. 1 is an exploded isometric view showing both a large chuck and the small chuck in their order of assembly and relative positions.

Referring first to FIG. 1, the overall exploded assembly view of one chucking system is depicted. It will be appreciated that for any veneer lathe chucking system two opposed rotatable chuck and spindle assemblies will be required, one for each end of a plyblock (indicated as 8 in FIGS. 6 and 7). The large chuck head is generally depicted at 10. Head 10 is mounted on its rotatable spindle 12 through an attachment structure which will be described in detail subsequently. Slidably mounted within head 10 is the small chuck head 14. Chuck head 14 is attached to a separate rotatable spindle indicated at 16 through a suitable mounting structure to be described in detail later.

Spindles 12, 16 are connected to suitable drive means (not shown) which includes associated speed control means and retraction and insertion means. The structure of this portion of the veneer lathe system is substantially state of the art apparatus. The respective spindles are laterally movable and keyed to one another for driving purposes and are adapted to sequentially extend outwardly for insertion into the plyblock and then retract based on the peeling sequence and knife travel as will be well recognized by those skilled in the art. The structural differences between the present invention and the existing spindle structures is essentially in the modifications to accomodate the attachment structure for heads 10, 14.

Prior to describing the attachment means for each head 10, 14 the detailed structure for heads 10, 14 will be given. Large chuck head 10 is circular and will be sized to have a diameter of approximately 7–9". The body of head 10 is comprised of an annular cylinder 18 having an inside diameter just larger than the outside diameter of small chuck head 14. About the outer circumferentially extending edge 20 of body 18, there is positioned a plurality of outwardly extending large chuck teeth, each indicated at 22. Positioned on edge 20 are approximately fifteen individual teeth which can be an integral part of body 18 and may be either machined into the structure or cast as part of an original casting. They should be offset from the teeth of the small chuck to reduce splitting. Between teeth 22 flats 24 are provided which will abut the end of a plyblock when teeth 22 are driven into the end of a plyblock.

Each of the individual teeth 22 are chisel-like in construction and have a length to width ratio of approximately 1:2. The number of teeth and the length to width ratio has been selected for optimum torque application during operation and to reduce splits and spinouts to a minimum.

Located at the opposite end of annular cylinder 18 is a circumferentially extending attachment flange 26 having a plurality of bolt holes 28 extending therethrough and uniformly spaced about the periphery. Extending radially inwardly from the attachment flange 26 is backing plate 30 which serves to reduce the size of the inside diameter of cylinder 18 and to serve as the backing member for small chuck head 14 as will become apparent later. An opening 31 in plate 30 is sized so as to be slightly larger in diameter than the diameter of small spindle 16.

The large chuck head 10 is adapted to be removably attached to the end of spindle 12 through the use of a split ring 32, 34 and extension collar 36. Split ring 32, 34 fits within the circumferential groove 38 spaced inwardly from the end of spindle 12. Spaced in a uniform manner about the periphery of both halves 32, 34 are bolt members each indicated at 40. A pair of bolts, each indicated at 42, serve to bolt the split ring 32, 34 together. The extension collar 36 extends over the outer periphery of spindle 12 from the split ring 32, 34 to the end of spindle 12 and preferably will be flush with the outer vertical face of spindle 12. Corresponding threaded bolt holes 44 are spaced about the inner edge 45 of collar 36 to allow collar 36 to be firmly attached to split ring 32, 34 over the end of spindle 12. About the outer edge 46 of collar 36 there are spaced a plurality of threaded bolt holes 47 to correspond with the bolt holes 28 within chuck head 10. To attach the chuck head 10 to the end of spindle 12, the plurality of bolt members 48 are inserted through the holes 28 and securely tightened so as to draw chuck head 10 firmly against the outer edge 46 of collar 36. To aid in aligning chuck head 10 to extension collar 36 is a pin 50 and a corresponding slot 52 within the collar 36.

Figure 7:
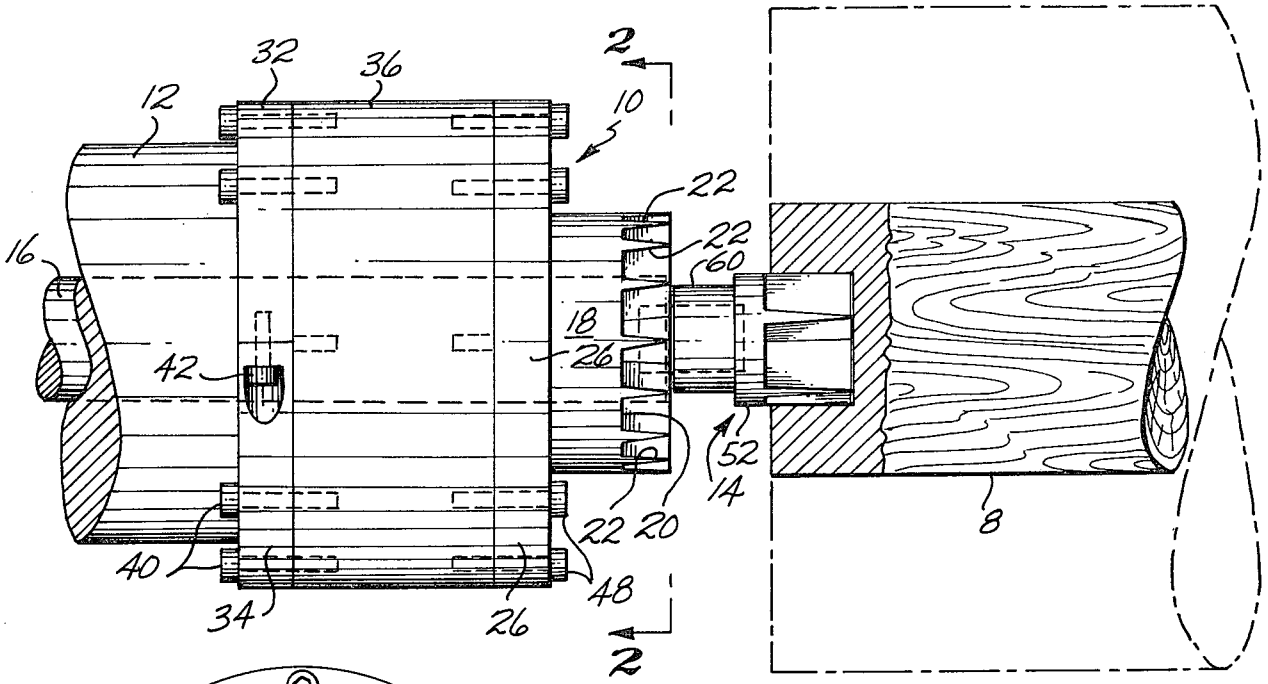
FIG. 7 is also a side view showing a large and small chuck assembly in operation after the large chuck has been retracted.
Figure 2:
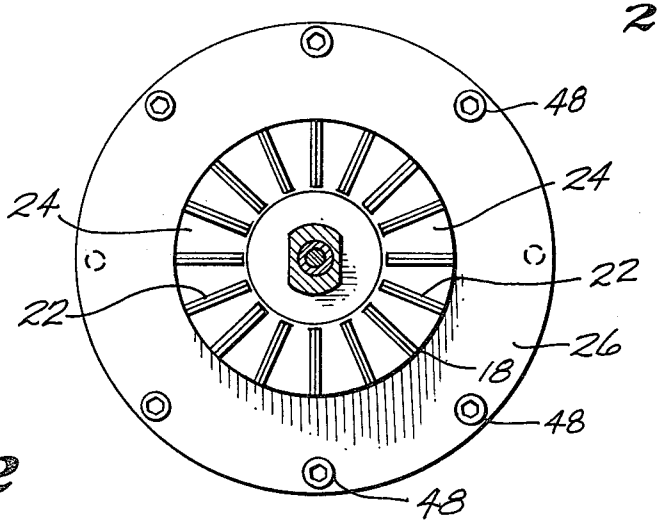
FIG. 2 is an end view taken along line 2—2 FIG. 7 and shows the chisel-like teeth on the large chuck in more detail.

By referring to FIG. 7, the bolted-in-place chuck head 10 may be seen in a side view and it is to be noted that the maximum diameter at the end of spindle 12 is through that portion where extension collar 36 is fixed in placed and the diameter of the cylinder 18 is less and this necked down feature is provided to allow a small diameter outer chuck body to be attached to the larger spindle.

Turning now to a detailed description of the small chuck head 14, reference will be made particularly to FIGS. 3–6. In FIGS. 3 and 4, the detachable small chuck head 14 is clearly shown. It has been found that for ease of manufacture, an investment casting forming process is most desirable. Of course, it will be recognized that the diameter of chuck head 14 is the determining factor with respect to the minimum core diameter that may be peeled, based on the fact that the veneer knife cannot be allowed to impact any portion of the chuck. In developing the present invention, experiments were conducted and the diameter of small chuck head 10 found to give satisfactory results was as small as 3½". With a diameter of 3½", theoretically a plyblock could be peeled down to a minimum core diameter of 3½" although for safety reasons the knife will retract earlier.

It has been determined, however, for most applications in most typical plywood platens, that a diameter on the order of 3¾" for small chuck head 14 is satisfactory. Therefore, the plyblock will be peeled down to a core diameter of something slightly greater than 3¾". Such a resulting core diameter still represents a significant improvement over prior art peeling.

Chuck head 14, when machined into its final shape, consists of a substantially circular base member 52 which has a plurality of outwardly extending substantially uniformly spaced chisel-like teeth 54 extending outwardly therefrom. In the embodiment depicted, five teeth 54 are shown and they are joined together at the center line of chuck head 14. Thus, a star-like pattern for teeth 54 is formed. Between adjacent teeth 54 on base member 52 are the flat sectors 56 forming the face of base member 52. Flat sector portions 56 form the abutment surface against which a plyblock will rest once the small chuck is inserted into the end of a plyblock.

The chisel-like teeth 54 are relatively thin and have a length dimension L and a width dimension W as depicted in the figures. The length dimension L has been found to be satisfactory ranging from ¾" up to 2½" with 1½" being a preferred dimension. Thus, when taking the preferred diameter of 3¾" with the preferred length, it will be appreciated that the length to width ratio will be approximately 1:1. The slenderness of the individual teeth 54 must be structured so they have adequate strength yet are not so thick at the base as to cause splitting of the plyblock. It has been found that satisfactory operation results if the base of each tooth is approximately 5/16" thick tapering to approximately 3/16" at the outer edge where a knife edge 58 may be provided. If the teeth at their bases are only 5/16" in thickness, then depending upon the diameter of chuck head 14, the flat base area comprised of sectors 56 will be more than 90% of the overall face area of base member 52. It may be seen, however, when referring to FIG. 5, that the relieved areas formed during the casting process will provide some curvilinear surface area for sectors 56.

Extending rearwardly from base member 52 and a part thereof, is attachment member 60. Attachment member 60 is smaller in diameter than base member 52 and the resulting circumferential abutment ring 62 is sized so as to abut the inside face of backing plate 30 when the small chuck head 14 is retracted. The outside diameter of attachment member 60 is sized so as to be slightly smaller than the inside diameter of opening 31 in backing plate 30.

Referring again to FIG. 1, the assembly for attaching chuck head 14 to spindle 16 is generally depicted at 64 and includes a threaded hole 66 within attachment member 60 together with a cooperating threaded hole 68 centered within the end of spindle 16 including a rectangular depression 70 preceding the beginning of the threaded portion of hole 68. Serving in part to attach chuck head 14 to spindle 16 is threaded member 72 having thread portion 74 and rectangular portion 76. Rectangular portion 76 is sized to correspond with rectangular depression 70 and the threaded portion 74 is sized so as to be threadable into threaded hole 66 of attachment member 60. Ultimately, the inner circular edge of attachment member 60 will be drawn up so as to abut the outer face of the small spindle 16. Internally threaded hole 78 extends through thread member 72 and accomodates a portion of the retaining threaded member 80 with the opposite end thereof sized to be threaded within threaded hole 68. Within threaded member 80 is another set of internal threads 82 to accomodate threaded retaining bolt 84. Also forming a part of the attachment assembly 64 is a washer ring 86 which will serve as the interface between spindle 16 and chuck head 14 when head 14 is tightened down. To make the attachment, the threaded member 72 is first seated within depression 70 and then the retaining member 80 and retaining bolt 84 are locked in place with pin 87. This leaves the threads 74 exposed and chuck head 14 can then be screwed on together with the washer ring 86 and firmly locked in place until detachment is desired.

OPERATION OF THE INVENTION

The sequential operation of the large and small chuck heads 10, 14 is substantially like state of the art sequential operation of a small and large chuck pair. The sequence is that when a plyblock is placed in a centered position by a suitable charging means, both sets of chucks are in their retracted positions, that is the spindles have been moved laterally to their inner retracted locations. At least one set of chucks will be constructed according to the present invention. Upon actuation, all chucks are moved outwardly and the teeth of each chuck will be imbedded within the end of a plyblock. In the present invention, both sets of teeth 22, 54 will be forced into the end of the plyblock substantially their full length where the plyblock will abut flats 24 and sector-shaped flats 56. When torque is applied through the chucks to the plyblock, the turning force will be exerted through pressure created against the plyblock by the flat side faces of teeth 22 and 54. Once the plyblock is rotating at speed, the lathe knife will be actuated to begin peeling a ribbon of veneer from the plyblock. As the knife moves radially inwardly towards the center line of the plyblock and the chuck heads 10, 14, it will approach a location radially spaced from the periphery of the large chuck head where a sensing means will detect its location and activate the retraction means for withdrawing the large chuck head 10 from the rotating plyblock. After the large chuck head is retracted, it will be laterally spaced a sufficient distance to avoid contact with the incoming knife.

The knife continues peeling veneer until it reaches a location sufficiently close to the periphery of the small chuck head 14 at which point another sensing means detects its location and causes the knife to retract after it has peeled the plyblock down to a predetermined minimum core diameter (see FIG. 7). At this point in the operating sequence, the core is ready to be dropped from the lathe in order to begin the process over again and the small chuck heads 10 are consequently retracted, thereby allowing the block to drop. The charging sequence is then repeated.

With the use of the chuck assembly of the present invention, spinouts are significantly reduced as are splitting problems in the ends of the plyblock. The thinness of the small chuck teeth combined with the flats to limit penetration tends to reduce the splitting problem while the length to width ratio appears to reduce the spinout problem. In addition, the structural design of the small chuck teeth being formed in a star pattern provides a self cleaning feature in that when a spinout does occur, the pieces of wood within the areas between teeth simply fall to the floor. Additionally, smaller core sizes can be realized over currently used chucking systems.

It should be appreciated that while a detailed description has been given of the preferred embodiment and its operation, modifications will become apparent to those skilled in the art and all such modifications are intended to be included within the scope of the appended claims.

What is claimed is:

1. A chuck for use in a veneer lathe assembly, comprising;

a substantially circular base member arranged and adapted for attachment to a rotatable spindle on a first end thereof, and a plurality of at least three thin chisel-like teeth each having a length L and width W in a ratio of approximately 1:1 extending outwardly from the base member on a second end thereof and joined together substantially along the center line of the chuck thereby forming a star-like tooth pattern and a plurality of flat sector shaped portions comprising at least 90% of the face area on the second end of the base member.

2. The chuck as in claim 1 having a plurality of five chisel-like teeth.

3. The chuck as in claim 1 in which the L and W dimensions are approximately 1½".

4. The chuck as in claim 1 including an attachment member positioned rearwardly of the base member for attaching the chuck to its rotatable spindle.

5. A chuck assembly for use in a veneer lathe assembly, comprising:

a substantially circular inner chuck attached to a rotatable and slidably mounted spindle, and a larger annular outer chuck attached to a rotatable and slidably mounted spindle which has an inside diameter larger than the outside diameter of the small chuck, comprising a body having a diameter less than the spindle to which it is attached and an outer circumferentially extending edge with thin chisel-like teeth positioned thereon which extend further outward and have a length and width, an attachment flange at the opposite end of the body, a collar extending between the end of the body and over the end of the large chuck spindle, a split ring for mounting on the large chuck spindle, and means for joining the collar to the split ring and to the body.

6. A chuck assembly as in claim 5 in which the length to width ratio of the teeth is approximately 1:2.

7. A chuck assembly as in claim 5 in which the larger chuck has a diameter within a range of from 7" to 9".

* * * * *